US005450652A

United States Patent [19]

Webb

[11] Patent Number: 5,450,652

[45] Date of Patent: Sep. 19, 1995

[54] HINGE MOUNTED DOOR CHOCK

[76] Inventor: Walter E. Webb, #709 Carson Ave., Oxon Hill, Md. 20745

[21] Appl. No.: 259,146

[22] Filed: Jun. 13, 1994

Related U.S. Application Data

[63] Continuation of Ser. No. 33,585, Mar. 18, 1993, abandoned.

[51] Int. Cl.[6] ..... E05F 5/02

[52] U.S. Cl. ..... 16/82

[58] Field of Search ..... 16/82, 223, 375

[56] References Cited

U.S. PATENT DOCUMENTS 83,967 11/1868 Howell ..... 16/223

4,831,688 5/1989 Deininger ..... 16/82

5,027,471 7/1991 Barnes ..... 16/82

FOREIGN PATENT DOCUMENTS 2258270 2/1993 United Kingdom ..... 16/375

*Primary Examiner*—Kurt Rowan

*Assistant Examiner*—Chuck Y. Mah

[57] ABSTRACT

A hinge mounted door chock is provided with an inverted J-shaped configuration. A first short leg is connected to a parallel longer and wider second leg by a third leg of equal width with the first leg. The side edges of the wider second leg are parallel to each other and the first leg and are flared outwardly away from the first leg.

1 Claim, 2 Drawing Sheets

HINGE MOUNTED DOOR CHOCK

CROSS-REFERENCE TO RELATED APPLICATION

This is a continuation of application Ser. No. 08/033,585 filed Mar. 18, 1993, now abandoned.

BACKGROUND OF THE INVENTION

In this day and age, security has become a major factor in building design. With all of the current new construction and the renovation of old buildings, members of the fire service (firefighters) are encountering more and more metal doors with metal jambs. Most of these doors also have closure systems. There is a need for fire service personnel to be able to prop any door in the open position. Despite the construction of the door or closure systems, with new metal style doors being heavier and stronger, a new type of door chock is needed for the fire service. The old style door chocks, such as the "wooden wedge" type, are not effective on these type of doors, especially with a smooth floor such as tile or finished concrete, as the chock will slide allowing the door to close. The old stand-by, a 16 penny nail, will not bite into a metal jamb and as with the "wooden wedge" type, will become disloged if the door is jarred.

SUMMARY OF THE INVENTION

The hinge mounted door chock of the present invention was designed to fit between the door and the jamb, at any hinge level. This will allow firefighters crawling due to heat and/or smoke conditions, the ability to chock a door in the open position from the lowest hinge level, without having to stand up. A hooked end will keep the chock in place should the door be jarred. While the hinge mounted door chock was designed with the fire service in mind, it could easily be adopted by others such as (police officers, emergency ambulance departments, security guards, hotel employees, moving companies, janitors, etc. with the need to prop doors open.

DETAILED DESCRIPTION OF THE INVENTION

Figure 1:
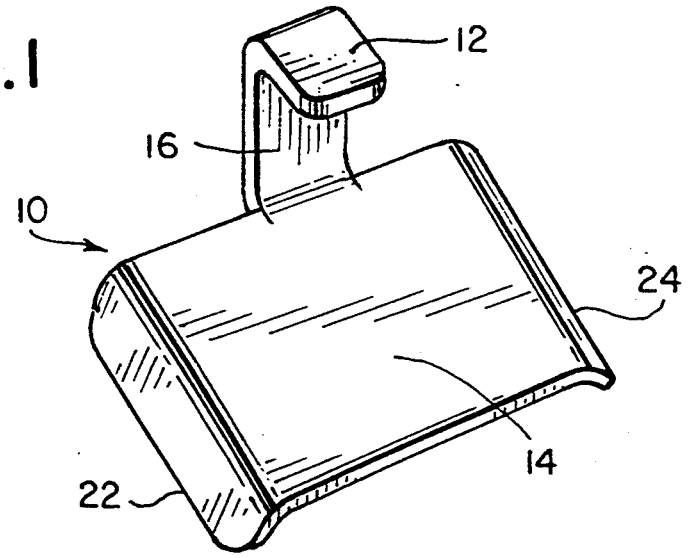
FIG. 1 shows a top view of the hinge mounted door chock
Figure 2:
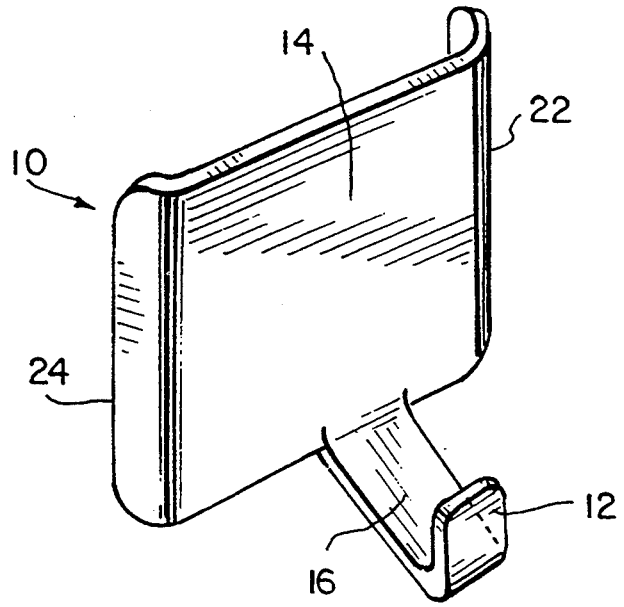
FIG. 2 shows a side view of the hinge mounted door chock
Figure 3:
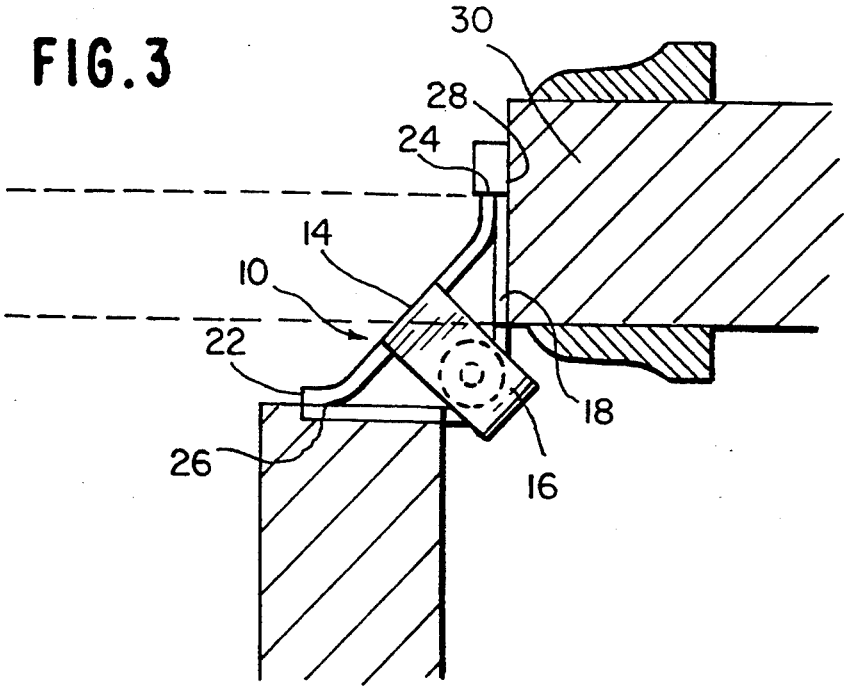
FIG. 3 shows a cut-a-way top view of the hinge mounted door chock in place, on the hinge of a door
Figure 4:
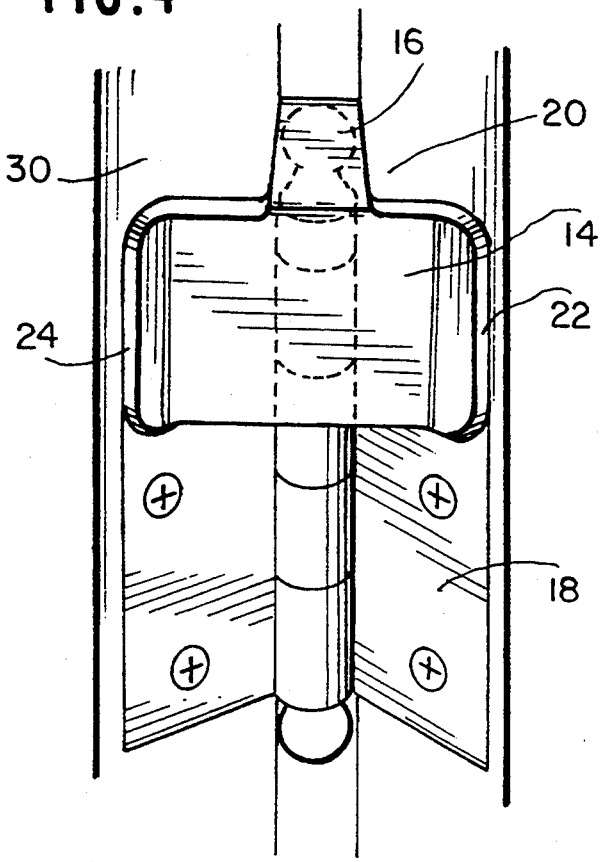
FIG. 4 shows a front view of the hinge mounted door chock in place, on the hinge of a door.

The hinge mounted door chock 10 was designed to be inserted between the door 20 and the jamb 30, over the top of a door hinge 18. The door chock 10 has an inverted J-shaped configuration consisting of a first short leg 12, a second long leg 14 and a third leg. The first and third legs 12 and 16 are flat and of equal width while the second leg 14 is substantially wider. The leg 14 of the door chock 10 is used to hold the door 20 open. The edges 22 and 24 of the leg 14 are flared out about 15 degrees to provide wide surfaces 26 and 28 respectively to hold the door open. The narrow hooked end defined by the first and third legs is placed over the hinge 18. The hooked end keeps the chock in place even if the door is jarred. This chock overcomes the properties of hinges, by not allowing it to bend closed because of the wide side, even with a closure system. The narrow hooked end ensures that the wide leg 14 remains in place, even if jarred, so the door 10 remains open. The narrow hooked end has sufficient depth to allow the hinge mounted door chock 10 to work on almost any door ranging from a wooden pre-hung residential style door to the hi-swing large double metal doors, despite being designed for use with a self closing metal door with metal jambs. Even with the weight of a ventilation fan hanging from the door and a working door closure system in place, the hinge mounted door chock 10 will be able to hold the door open even if it is jarred. All corners of the hinge mounted door chock 10 are rounded to prevent the chock from wearing holes in running gear pockets. With the hinge mounted door chock 10 designed for the heavy duty use required by the fire service, it is currently made from metal. If this chock was to be adopted by others whose requirments are not as demanding as that of the fire service, it maybe made from wood or plastic. The hinge mounted door chock 10 is almost indestructible when made from metal, and has no moving parts. It is reusable and lightweigth, allowing firefighters to carry several in running coat pockets.

I claim:

1. A door chock adapted to be hooked over a door hinge comprising:

an inverted J-shaped metal plate consisting of a first short leg, a second long leg parallel to said first short leg and a third leg interconnecting said first and second legs, said third leg being disposed perpendicular to said first and second legs;

wherein said first and third legs are flat and equal in width for overlying a door hinge and wherein said second leg is flat, rectangular and substantially wider than the width of said first and third legs and is provided with flared side edges extending parallel to and being bent away from said first leg to provide wide side surfaces to hold the door open.

* * * * *